US005954276A

United States Patent [19]

Hintikka et al.

[11] Patent Number: 5,954,276

[45] Date of Patent: Sep. 21, 1999

[54] METHOD FOR GRINDING OF GRANULAR MATERIAL AND GRINDING EQUIPMENT

[75] Inventors: Väinö Viljo Heikki Hintikka; Raimo Tapio Tahvanainen; Markku Elias Kuusisto; Pekka Pärttyli Mörsky; Veli Tapio Knuutinen, all of Outokumpu, Finland

[73] Assignee: Valtion Teknillinen Tutkimuskeskus, Finland

[21] Appl. No.: 08/913,147

[22] PCT Filed: Mar. 7, 1996

[86] PCT No.: PCT/FI96/00140

§ 371 Date: Nov. 24, 1997

§ 102(e) Date: Nov. 24, 1997

[87] PCT Pub. No.: WO96/27443

PCT Pub. Date: Sep. 12, 1996

[30] Foreign Application Priority Data

Mar. 8, 1995 [FI] Finland ..... 951085

[51] Int. Cl.[6] ..... B02C 17/00; B02C 23/08

[52] U.S. Cl. ..... 241/21; 241/24.1; 241/24.11; 241/27; 241/34; 241/38; 241/171

[58] Field of Search ..... 241/21, 24.1, 27, 241/36, 38, 79, 171, 15, 24.11, 34

[56] References Cited

U.S. PATENT DOCUMENTS

| | | | |
|---|---|---|---|
| 3,094,289 | 6/1963 | Fahlstrom et al. | 241/34 |
| 3,887,142 | 6/1975 | McElvain | 241/79 |
| 4,026,479 | 5/1977 | Bradburn et al. | 241/30 |
| 4,119,699 | 10/1978 | Kellerwessel et al. | 241/15 X |

FOREIGN PATENT DOCUMENTS

| | | |
|---|---|---|
| 400229 | 8/1924 | Germany . |
| 665654 | 9/1938 | Germany . |
| 10623 | 11/1897 | Sweden . |
| 1305864 | 2/1973 | United Kingdom . |

*Primary Examiner*—John M. Husar
*Attorney, Agent, or Firm*—Lahive & Cockfield, LLP

[57] ABSTRACT

A method and apparatus for grinding granular solids in liquid slurry form within a mill. The solids density of the feed slurry is maintained below the solids density in the mill, thus causing the liquid to flush through the mill, preferentially carrying and discharging finer relative to coarser particles. Discharged solids thus have a smaller concentration of overground solids, and grinding capacity and power consumption by the mill are optimized.

13 Claims, 13 Drawing Sheets

METHOD FOR GRINDING OF GRANULAR MATERIAL AND GRINDING EQUIPMENT

Figure 1:
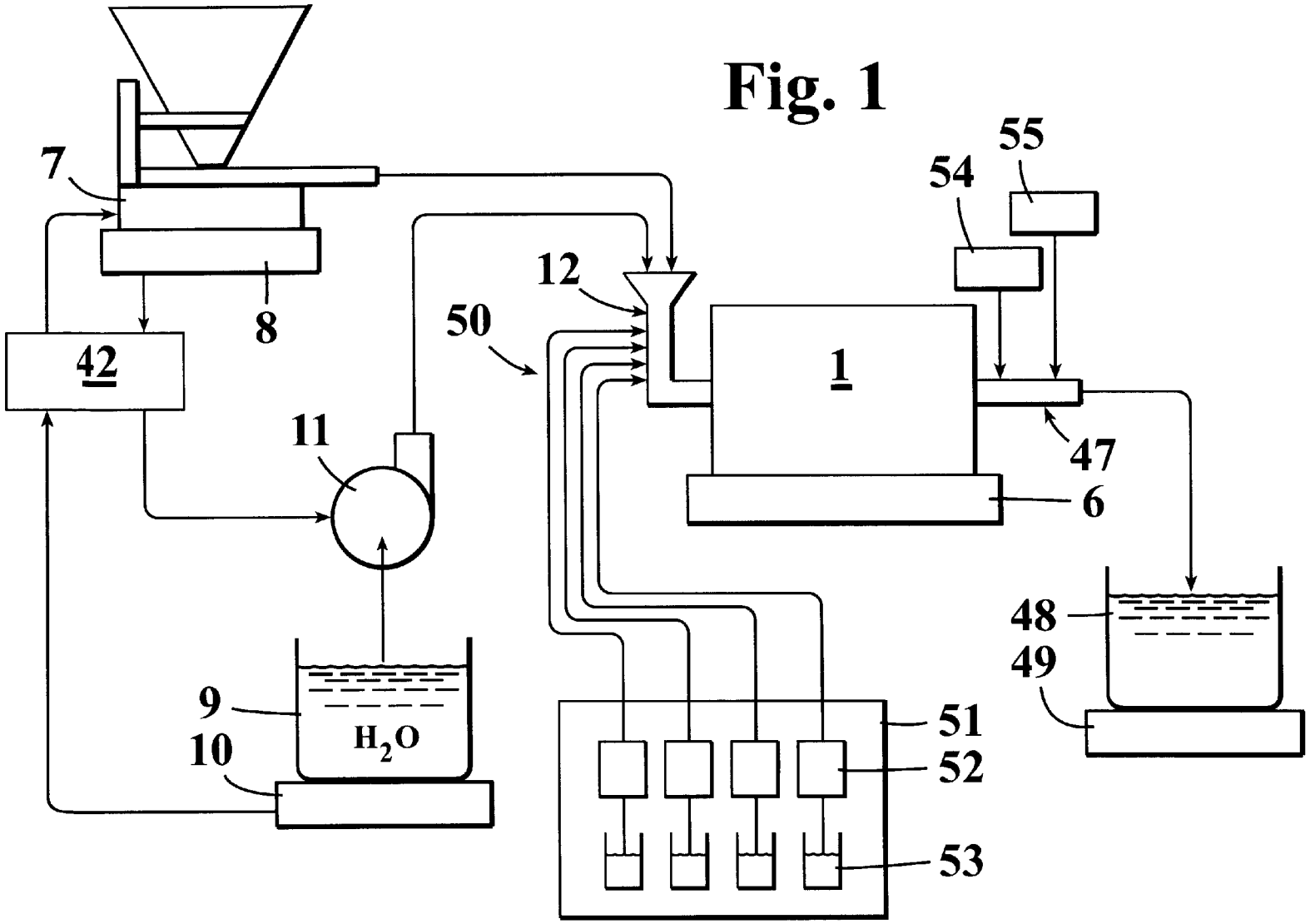

The invention relates to a method for grinding granular material, particularly ore material. The invention also relates to a grinding apparatus for such material.

In the prior art there is known a grate mill whereby coarse granular ore material is ground for further processing, particularly for flotation or other such concentration. It is typical of the wet grinding process realized in a grate mill that the slurry density in the process feed is of the order 50–65% by weight, i.e. the solids/water ratio in the material to be fed into the mill is equal or larger than 1, and that said slurry density is practically always the same as the steady-state density of the slurry formed in the mill. In that case the materials always proceed in the mill as a so-called plug flow, in which case water and solids proceed at the same rate through the mill. Thus it has been traditionally understood that a well-working grinding process self-evidently comprises a high volumetric filling of the mill and a high slurry density. From a grate mill, the product has been obtained as a thick flow from the output orifices of the mill.

A drawback with the above described ordinary grinding process is that the ore material is easily overground or slimed, i.e. part of the material is ground into too small particles. This brings about problems in the further processing product ground from ore material. Another drawback is that sliming uses a lot of energy; as is well known, fine grinding is a highly energy-consuming process.

In practical industrial-scale processes, the grinding of ore material almost without exception takes place in continuous operation. In laboratory-scale experiments, comminution has traditionally been carried out in a batch grinding process. However, it is a general notion that batch grinding and continuous grinding lead to different end products—the former renders more fine material in the grain size distribution than the latter. The softer the material to be ground, the bigger the difference. Consequently the grinding of experimental material in research does not necessarily give a correct prediction of the industrial-scale product.

The object of the present invention is to improve the grinding process, particularly the laboratory-scale process. It will, however, be appreciated that the method of the invention also is suited to an industrial-scale process. Another object of the invention is to introduce a new grinding apparatus for applying the method of the invention.

The method of the invention for grinding granular material, particularly ore material, as feed comprises precomminuted ore material or corresponding solids and water, which solids are ground to a mill product with a given grain size distribution. According to the invention, the grinding of the feed and the classification of the mill product into fine and coarse solids are carried out during the same step in the grinding apparatus, so that in the grinding, there is used so much water in proportion to solids that the part of the mill product that has reached a given grain size is flushed more rapidly out of the grinding chamber than the coarser part, and this coarser part remains in the grinding apparatus until it is ground to the desired grain size.

In another method according to the invention, in order to grind granular material, particularly ore material, as feed there is precomminuted ore material or similar solids and water, which are fed into a mill serving as the grinding apparatus and comprising a grinding chamber provided with a grinder charge, in which grinding chamber solids are ground, and from the grinding chamber there is obtained the mill product with a given grain size distribution. According to the invention, the solids/water ratio in the feed, i.e. its solids content or slurry density is adjusted to be such that it is of the order 45% by weight or less; now the solids content of the slurry being treated in the grinding chamber sets at a steady-state slurry density which is higher than the slurry density in the feed, advantageously within the range of 45–65% by weight, and the excess water is made to flow through the grinding chamber in average faster than the solids. Now the solids to be treated in the grinding process are classified, so that the coarse material in the slurry stays longer in the mill grinding process, whereas the fine material is discharged more rapidly from the mill along with the excess water flow, and the grain size distribution in the ground product is essentially established on a level which contains essentially less fine grain elements than with a normal, high slurry density grinding. Consequently, the first stage of classification in the grinding process takes place by means of the water flow.

In the grinding method of the invention, the slurry density of the feed is adjusted to be such that its solids content is advantageously within the range of 25–45% by weight. However, it is pointed out that the slurry density of the feed may fall below 25% by weight; it may even be within the range of 15–25% by weight. The lower limit to the slurry density of the feed is ultimately set by the next process, which normally is a concentration process, such as flotation or the like. In a flotation process, the slurry density is of the order 15–20% by weight.

The grinding apparatus according to the invention comprises a mill provided with a grinding chamber and a grinder charge contained therein in order to realize the grinding proper; said mill includes feed and discharge openings, feeding means for supplying the feed formed of precomminuted ore material or corresponding solids and water to the mill through the feed inlet, and discharge means for letting the product out of the mill, said mill product having a defined grain size distribution. According to the invention, the feed means include a device for adjusting the slurry density in the feed, which device sets the slurry density on a relatively low level. The slurry density of the feed is set on a level which is of the order 45% by weight at maximum, but can fall clearly below this. In the grinding process, there is in that case used so much water in relation to the solids that the mill product that has achieved a determined grain size is flushed more rapidly out of the grinding chamber of the grinding apparatus than the coarser element, and this coarser element remains in the grinding apparatus until it is ground to the desired size. In this type of grinding apparatus, the first stage of classification takes place by means of the water flow.

The principle of operation in the grinding method and apparatus of the invention is classifying. It is an advantage of this grinding process that the grain size distribution of the resulting mill product is optimized in such a fashion that it no longer contains remarkable amounts of overground fine solids, as is often the case with known grinding processes. The optimization of the grain size distribution is based on the realization that the slurry density of the feed is kept relatively low, i.e. the amount of water in relation to the solids is kept large, in which case in the mill grinding chamber there is formed a steady-state pulp density higher than the feed slurry density. Now the excess water proceeds through the grinding chamber remarkably faster than the solids. This water flushing through the grinding chamber effectively carries the fine grain size classes of solids through the grinding chamber. Hence the fine grain size classes are saved from sliming.

Another advantage of the grinding process of the invention is that energy is saved; it is well known that the grinding of fine material into even finer material is a process that requires a lot of energy. By applying the method of the invention, the overgrinding of fine materials can be prevented. This is an advantage for many concentration processes, because the extremely fine material (slime) makes the process more difficult (increases costs and simultaneously weakens the obtained concentration result).

The invention and its advantages are explained below in more detail with reference to the accompanying drawings, where

Figure 3:
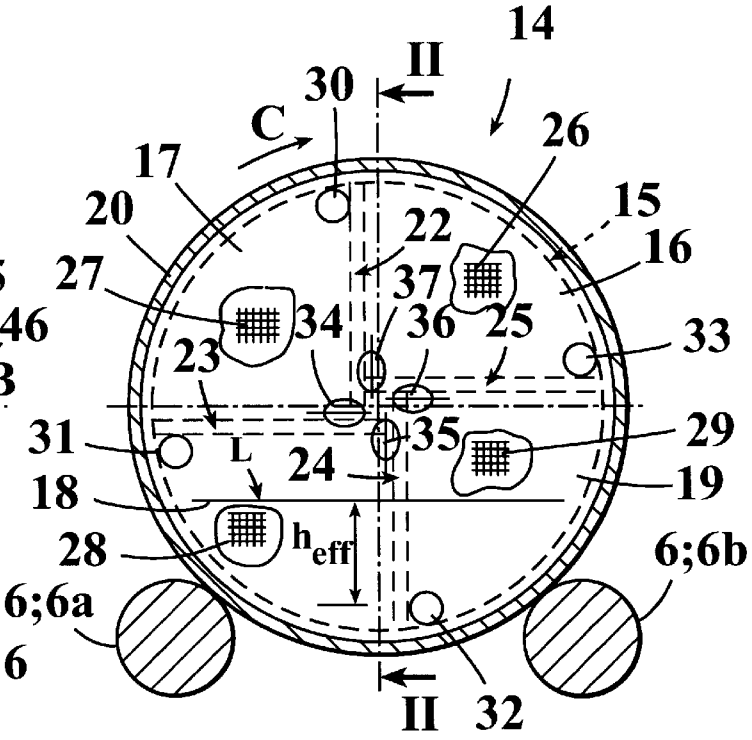
Figure 2:
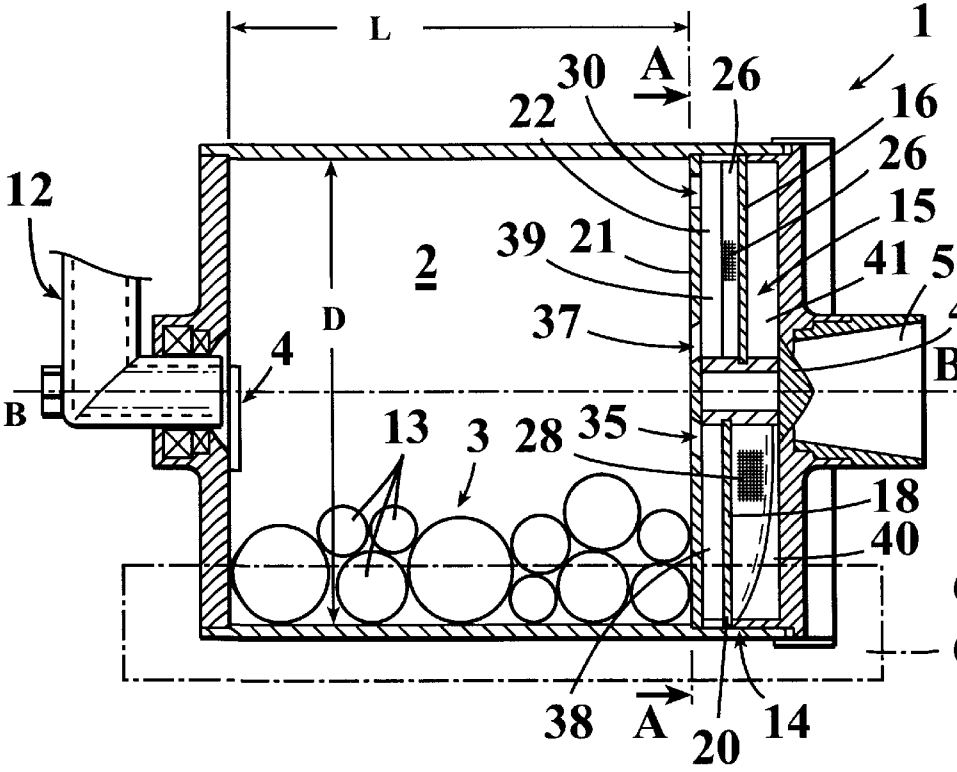
Figure 4:
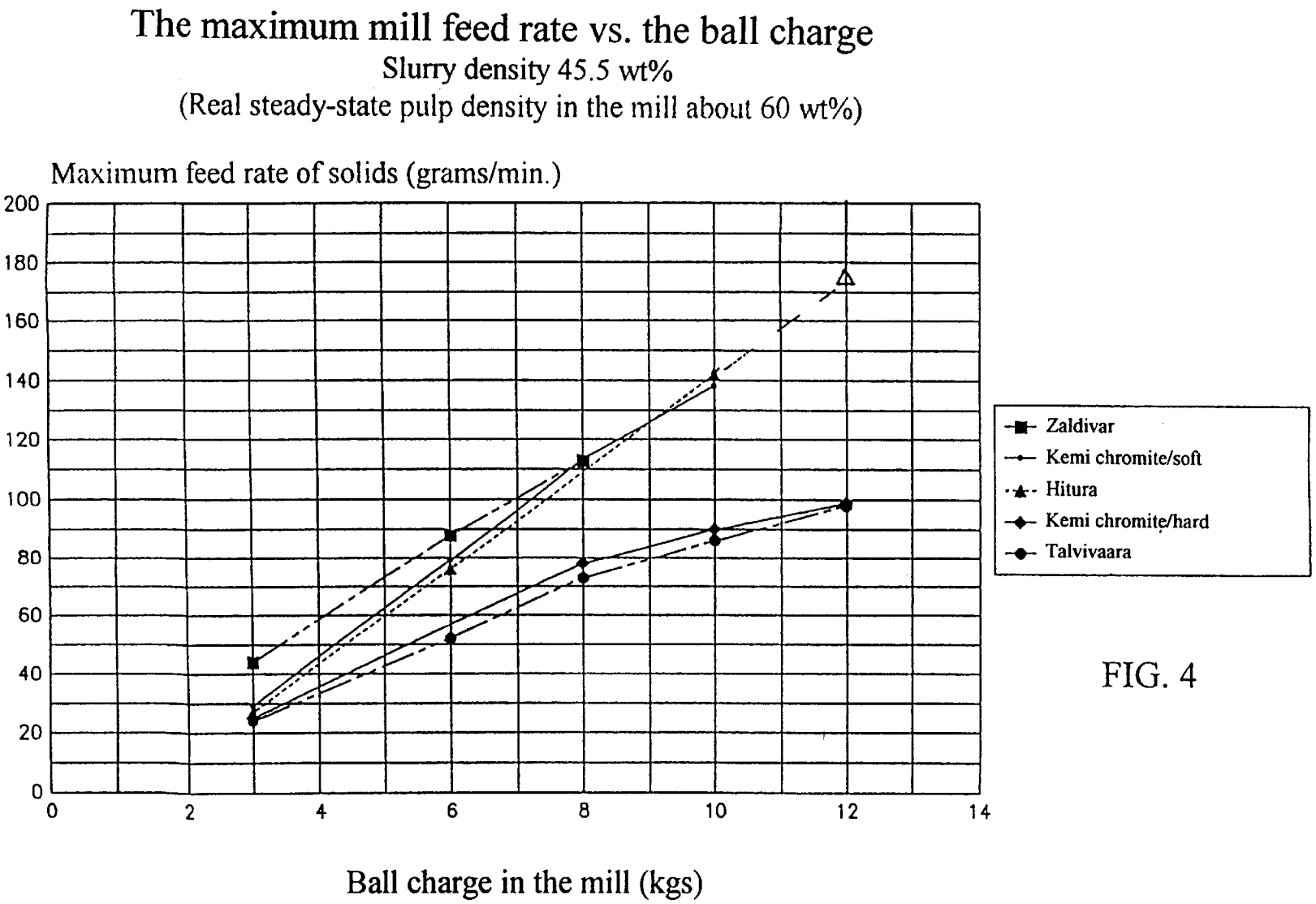
Figure 5:
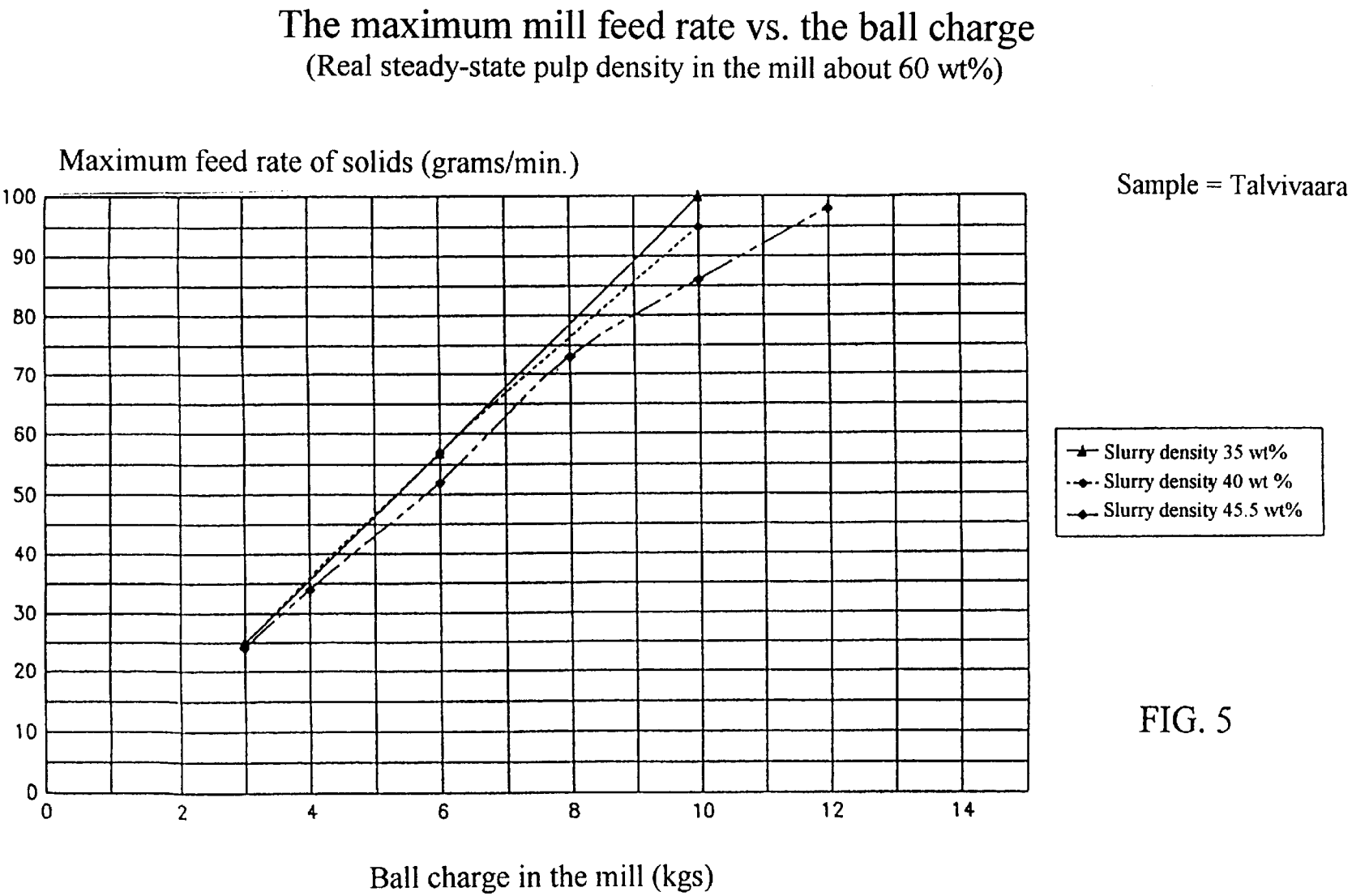
Figure 6:
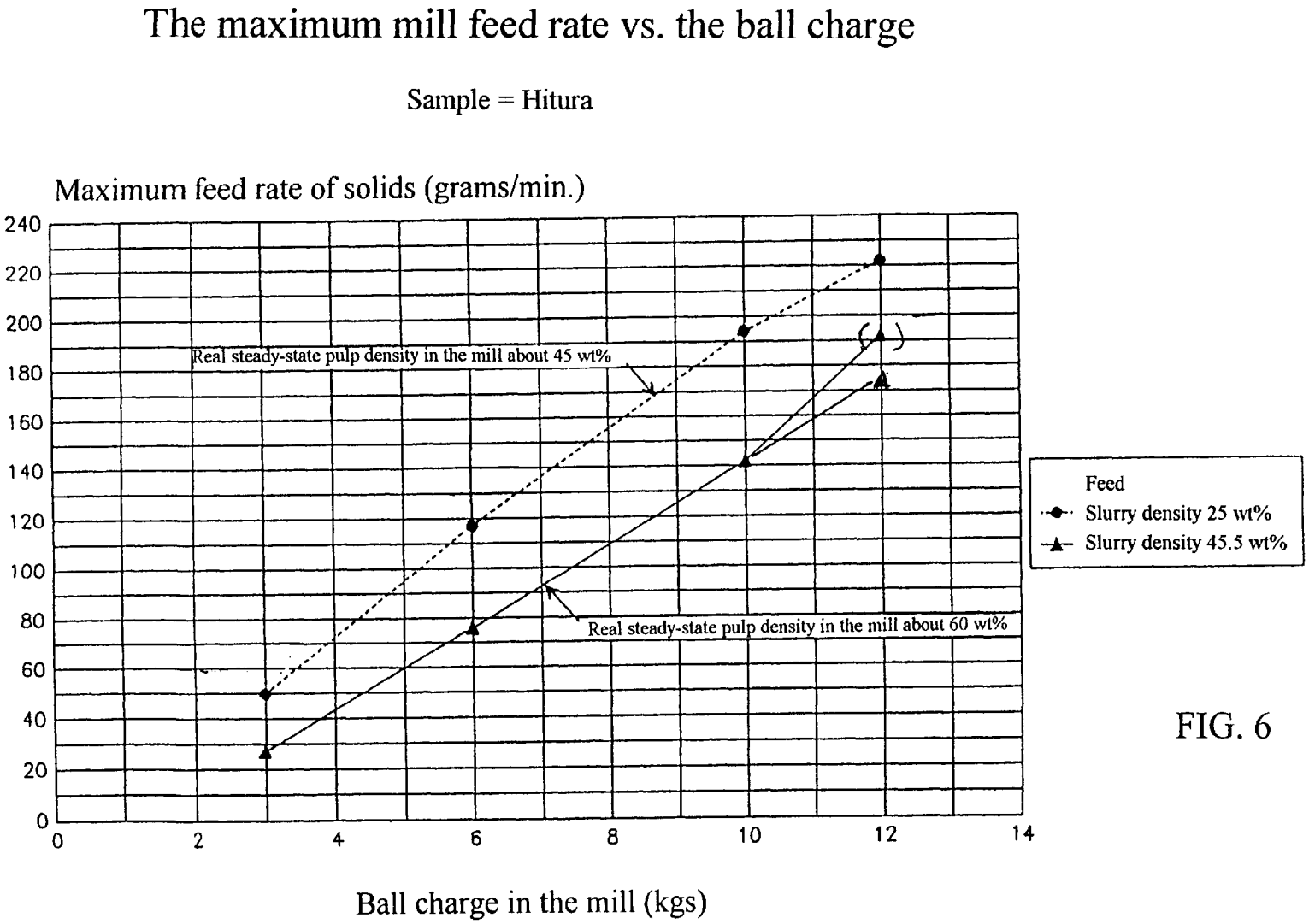
Figure 7:
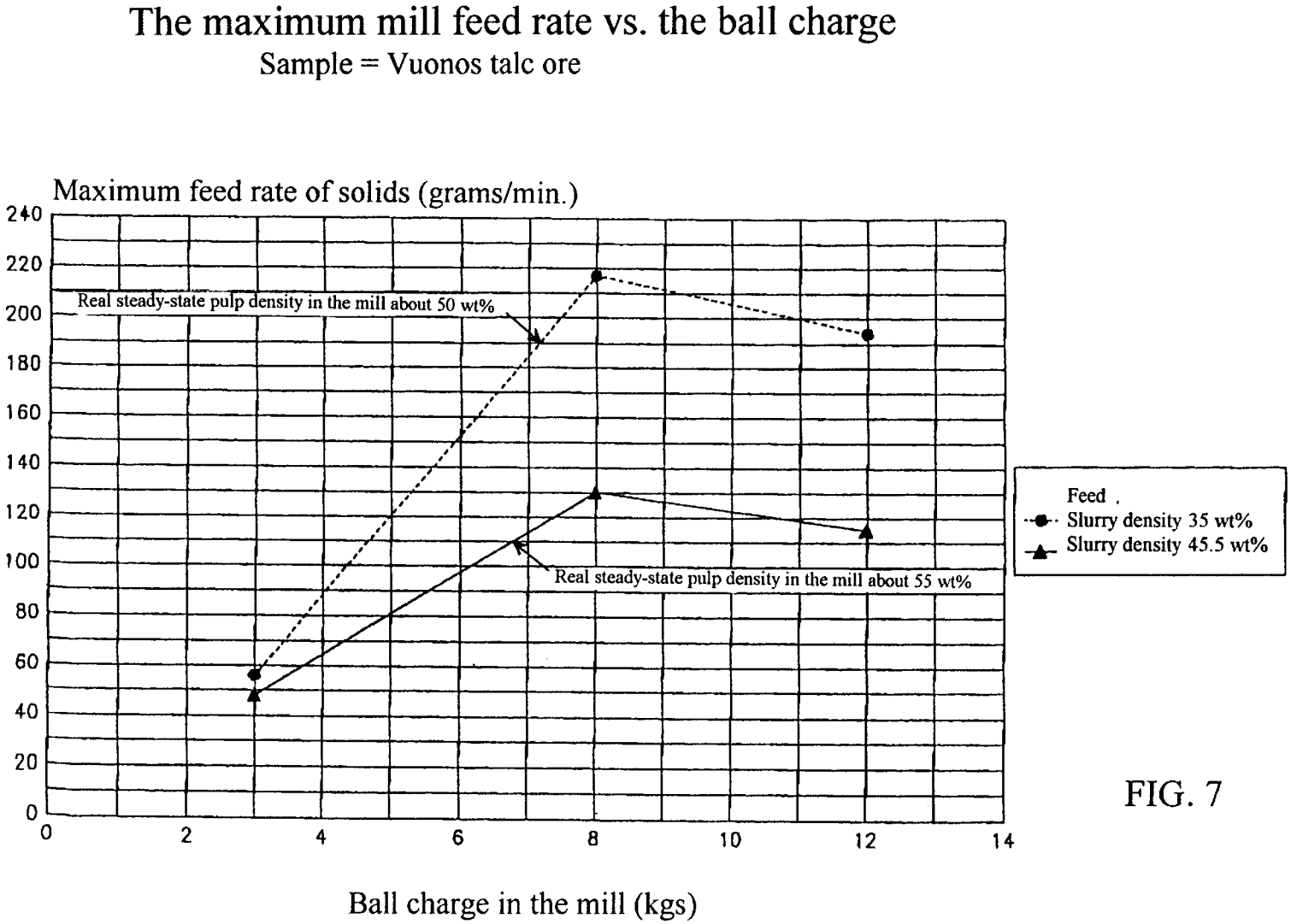
Figure 8:
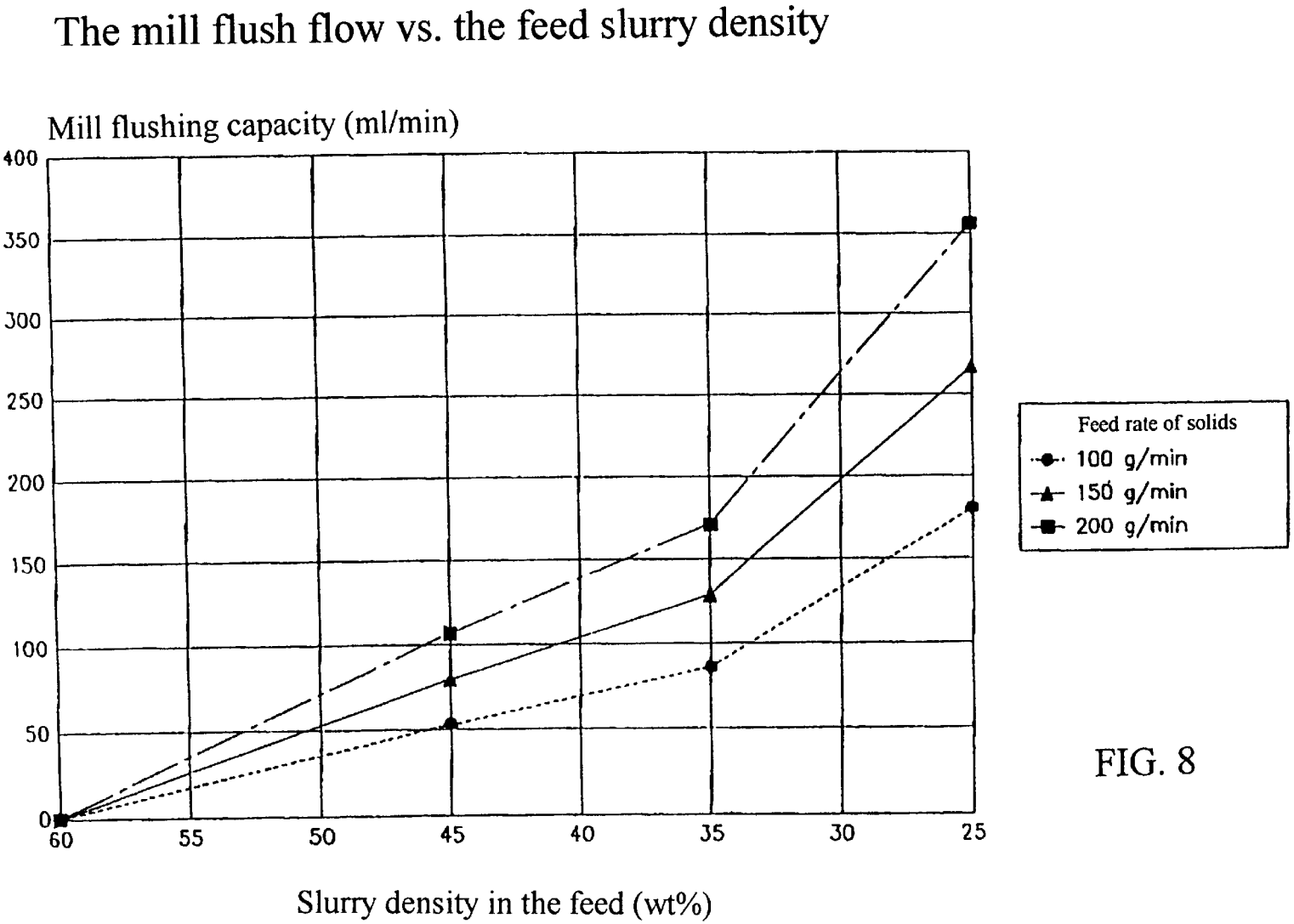
Figure 9:
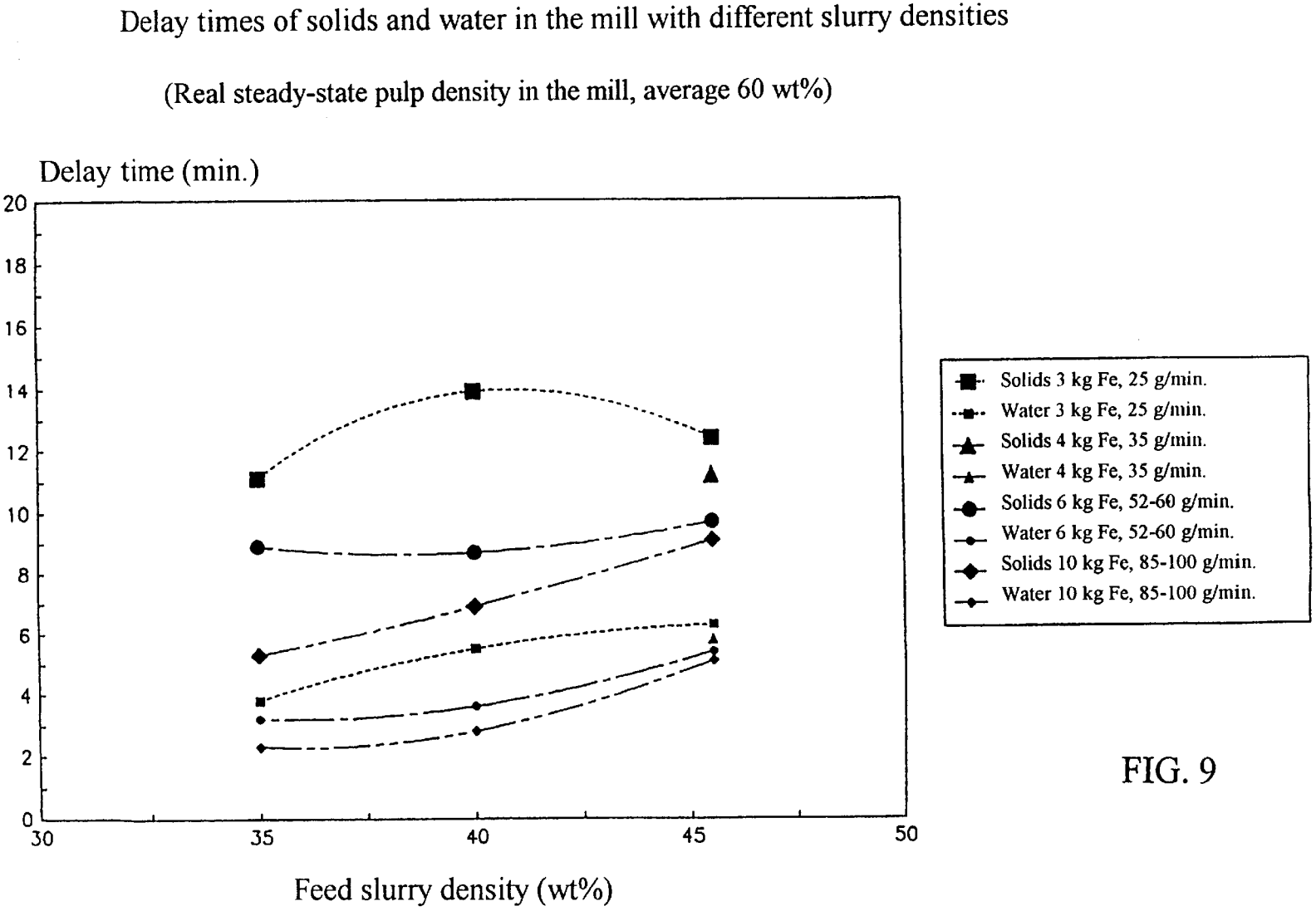
Figure 10:
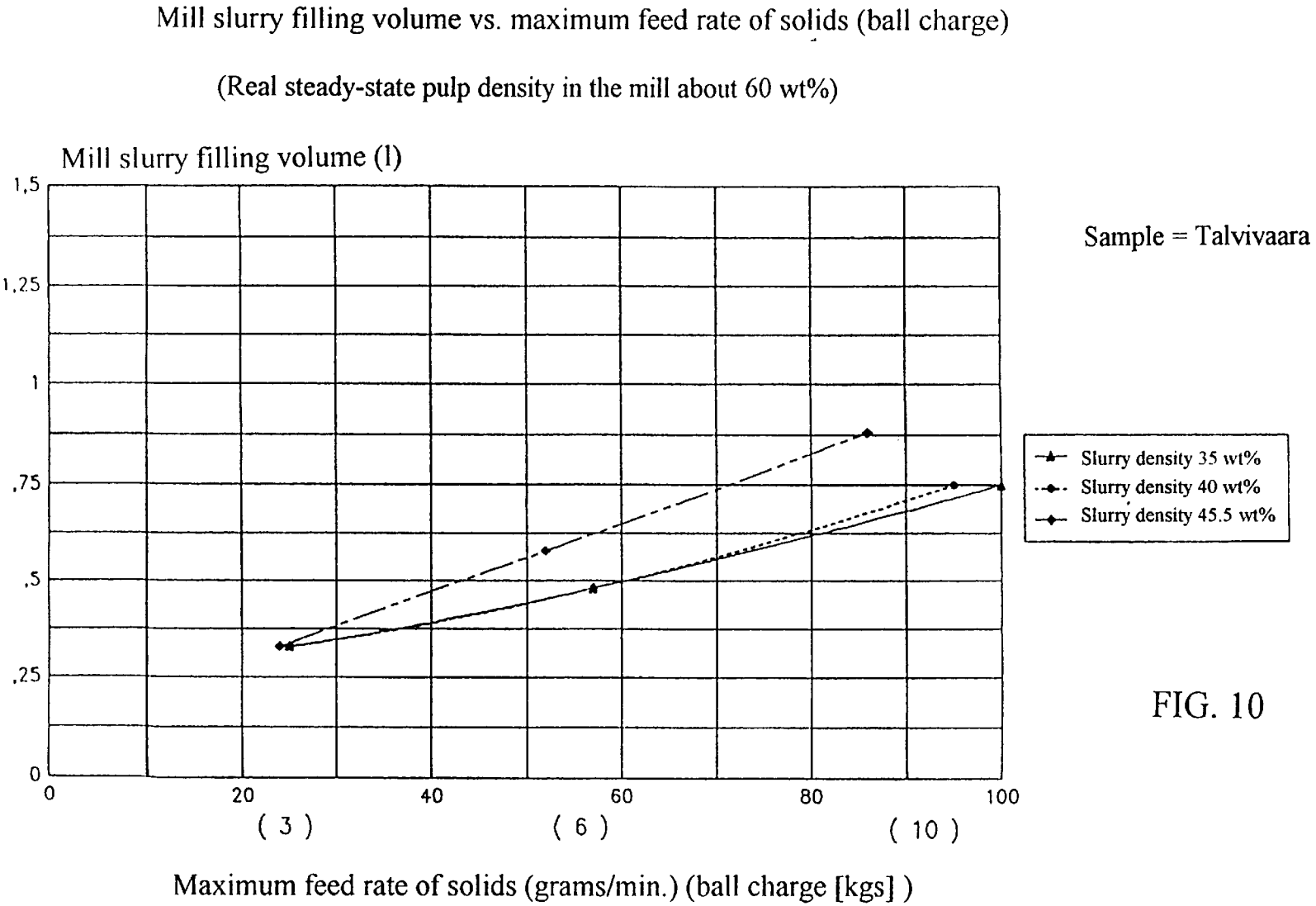
Figure 11:
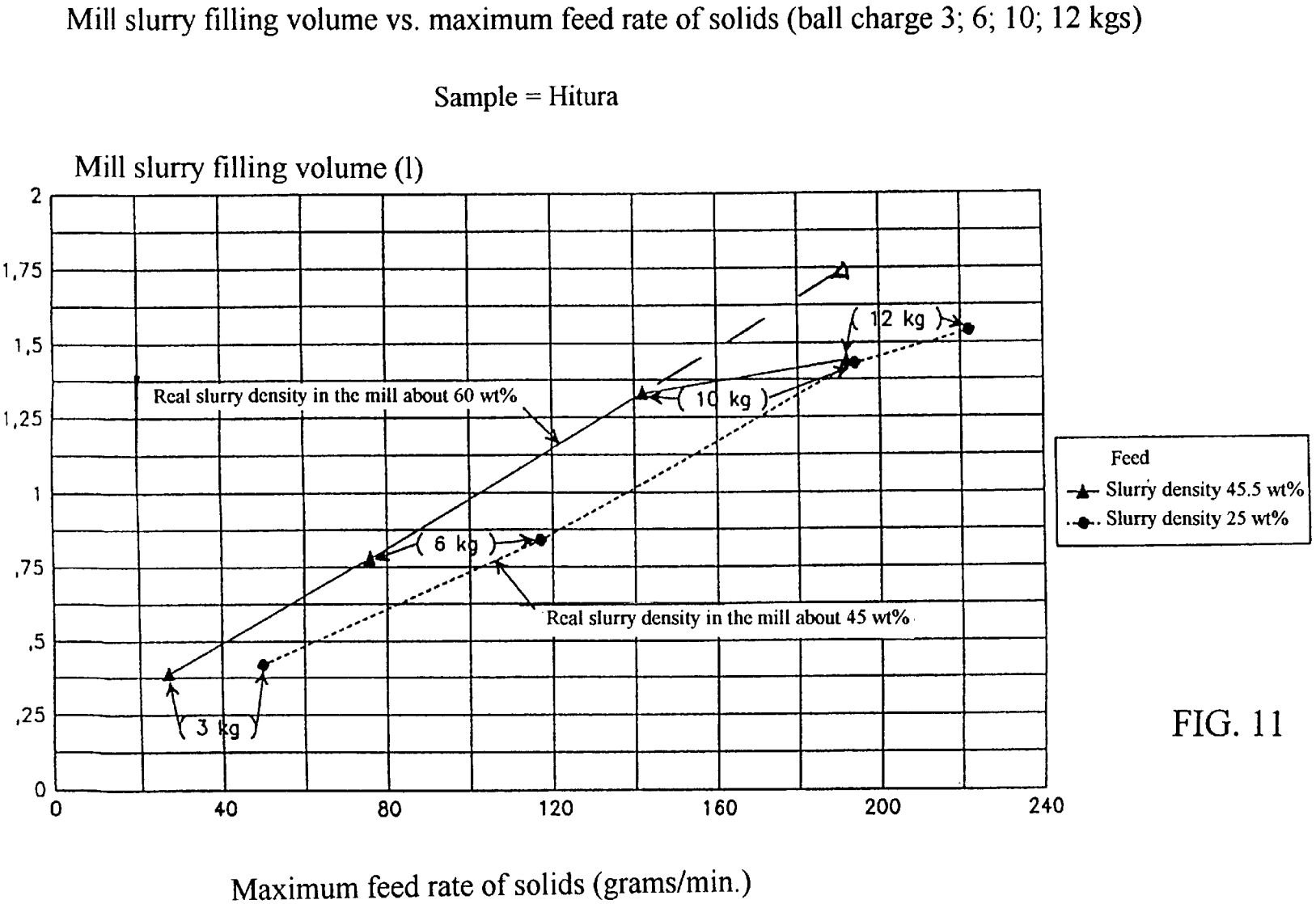
Figure 12:
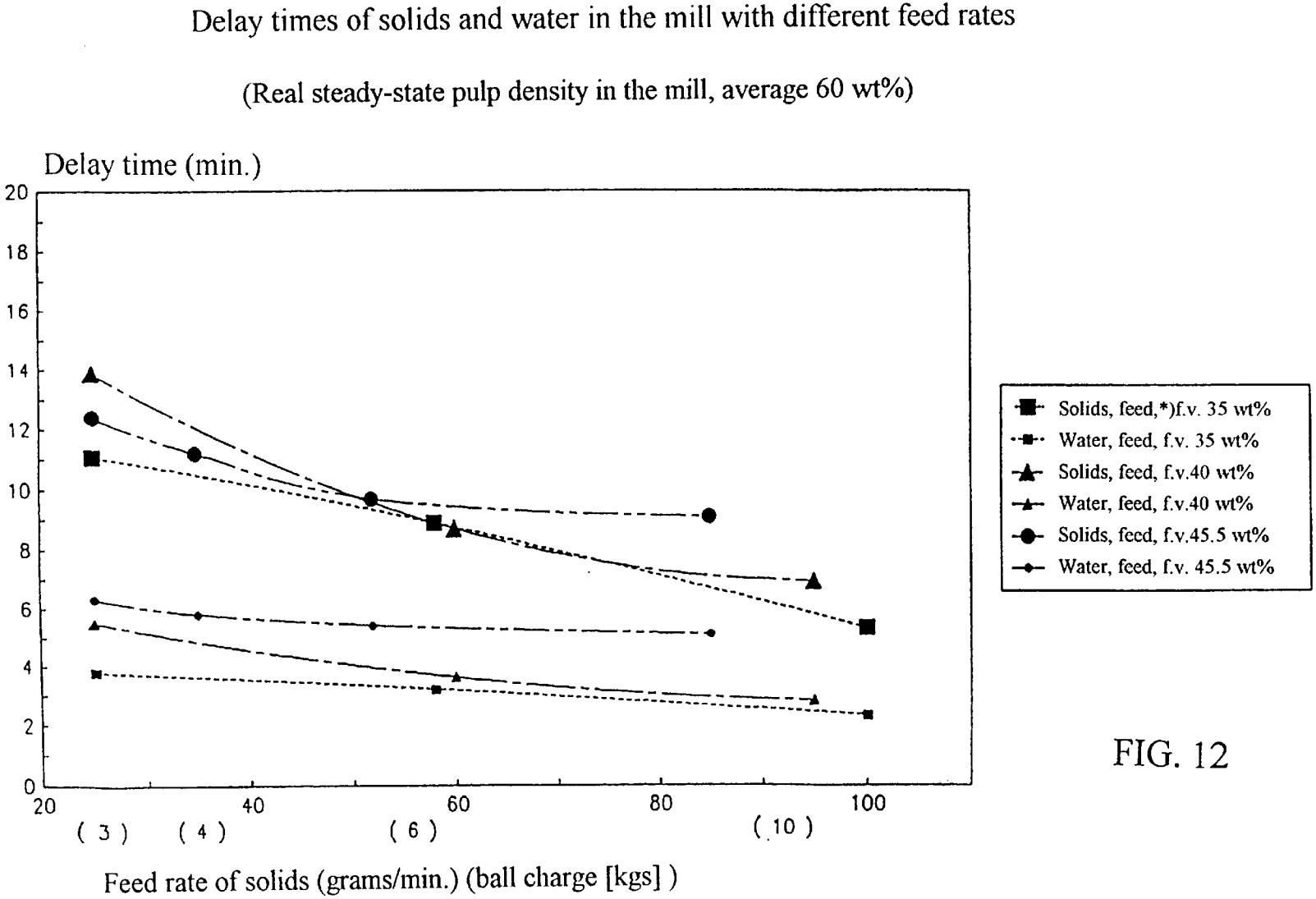
Figure 13:
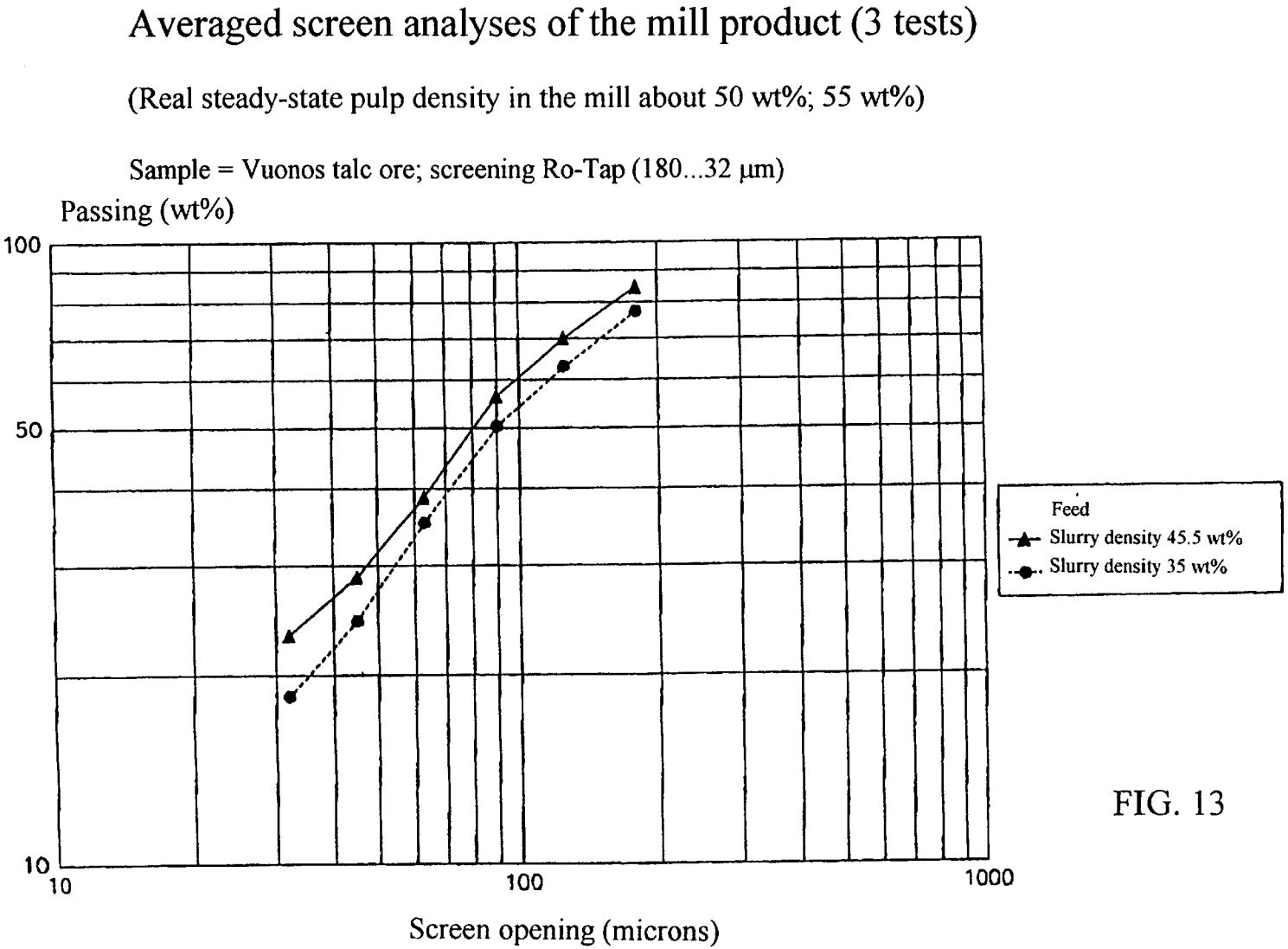
Figure 14:
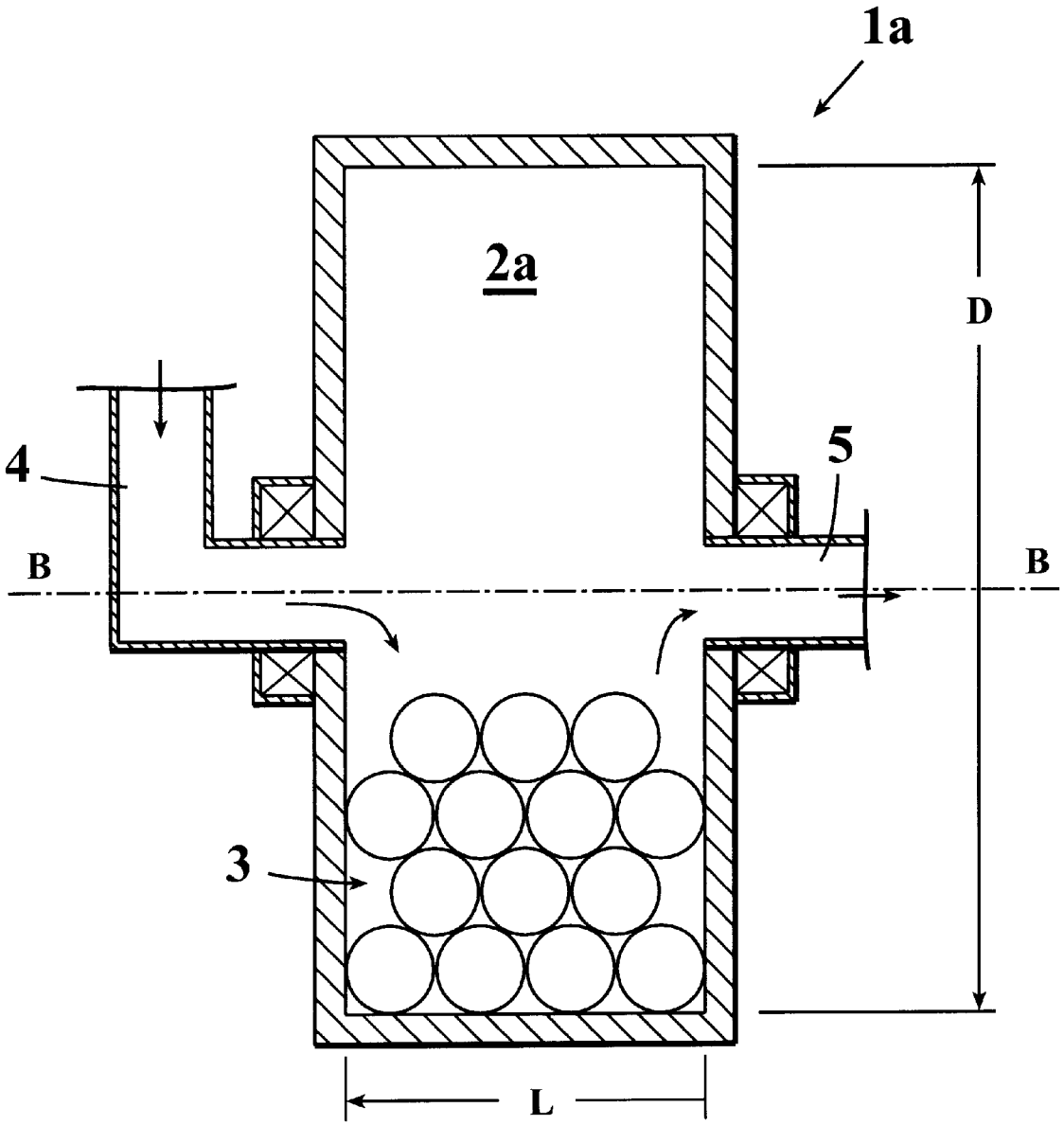

| | |
|---|---|
| FIG. 1 | illustrates a grinding apparatus according to the invention; |
| FIG. 2 | illustrates the mill of the grinding apparatus in a lengthwise vertical cross-section along its axis; |
| FIG. 3 | is a cross-section A-A of the mill of FIG. 2; |
| FIG. 4 | illustrates the dependence of the mill capacity on the size of the ball charge with some examined ore materials; |
| FIG. 5 | illustrates the dependencies of the mill capacity, the ball charge and the mill feed with one ore material; |
| FIG. 6 | illustrates the dependencies of the mill capacity, the ball charge and the mill feed slurry densities with another ore material; |
| FIG. 7 | illustrates the dependencies of the mill capacity, the ball charge and the mill feed slurry densities with a third ore material; |
| FIG. 8 | illustrates the flow volumes of the free water passing through the mill with varying feed slurry densities; |
| FIG. 9 | illustrates the delay times of solids and water in the mill with varying feed slurry densities; |
| FIG. 10 | illustrates the ratio of the mill feeding rate to capacity with varying feed slurry densities for one ore material; |
| FIG. 11 | illustrates the ratio of the mill feeding rate to capacity with varying feed slurry densities for another ore material; |
| FIG. 12 | illustrates the delay times of solids and water in the mill with varying feed rates and slurry densities of the feed; |
| FIG. 13 | illustrates the measured values of the grain size distribution of the mill product of a given ore material with varying feed slurry densities; and |
| FIG. 14 | illustrates another mill of the grinding apparatus in cross-section along the lengthwise axis. |

The grinding apparatus of the invention is schematically illustrated in FIG. 1. The grinding apparatus comprises a mill, which is represented in more detail in FIGS. 2 and 3. The mill 1 is provided with a grinding chamber 2. The grinder charge 3, in this case a ball charge, is arranged in the grinding chamber 2 in order to realize the grinding proper. The grinding chamber 2 is a cylindrical space, the opposite ends whereof are provided with a feed opening 4 and a discharge opening 5. The grinding chamber 2 is arranged on top of rollers 6, whereby the grinding chamber 2 can be rolled around its lengthwise axis B—B.

The grinding apparatus also includes feeding means for feeding the slurry formed by preground ore material and water, i.e. the feed, into the grinding chamber 2 of the mill 1 through the feed opening 4. Respectively, the grinding apparatus includes discharge means for discharging the mill product from the grinding chamber 2 of the mill 1 through the discharge opening 5. The feeding means include a device for adjusting the slurry density, which device in this embodiment comprises a vibrating feeder 7 or a corresponding feeder, and a balance 8 provided in connection thereto for weighing the solids to be fed by the vibrating feeder, and a water tank 9 or the like, a balance 10 for weighing the water tank and a pump 11 for pumping water. The outlet of the vibrating feeder 7 is connected to the feed channel 12 of the mill 1 and the feed channel is further connected, via the feed opening 4 to the grinding chamber 2. Likewise, the outlet of the water pump 11 is connected to the feed channel 12. The device for adjusting the slurry density also comprises a control unit 42 for administering solids and water in suitable proportions and as a suitable total volume.

By means of the above described feeding members, the fairly large-grained solids and water to be fed in the mill 1 are mixed in the feed channel 12, in certain weight proportions, so that a desired slurry density for the feed is obtained. The adjusting of the slurry density is realized by adjusting the vibrating feeder 7 and the pump 11 on the basis of the weight information given by the balances 8 and 10, by means of the control unit 42.

Obviously the feeding members can be realized by means of other devices than those suggested above for administering the feed, i.e. water and solids, into the mill and for defining and adjusting the slurry density.

The feed, which is thus formed of granular solids and water, is conducted via the feed channel 12 and the feed opening 4 to the grinding chamber 2 of the mill 1. In the grinding process, the grinding chamber 2 is rotated around its lengthwise axis B—B by means of the rotating device 6. Now the grinder charge 3, such as a ball charge, composed of single grinder pieces such as balls 13, moves at the bottom of the grinding chamber 2, and while it moves and rolls, it grinds the solids fed into the grinding chamber 2 into smaller and smaller particles.

The rolling device 6 comprises two horizontal, parallel rotary axes 6; 6*a,* 6*b,* one of which, for instance the rotary axis 6*a,* is most advantageously rotated by means of an electric motor and a suitable transmission device. In order to reliably measure the real power, i.e. rotary power, required by the mill 1, a suitable torque measuring device is connected to the rotary axis 6*a* in order to measure the torque strain directed thereto. Such a torque measuring device is for instance a strain gauge detector, which is attached to the rotary axis 6*a*. Now the rotary power is measured directly from that rotary axis which is rotated by an electric motor or a similar actuator, in which case exactly the power required by the mill is directly measured.

In the embodiment of FIG. 2, in connection with the discharge opening 5 of the grinding chamber 2 of the mill 1 there are provided discharge means. The discharge means advantageously include a pump device which in this embodiment of FIGS. 2 and 3 is realized by means of a pumping and screening classifier 14. The proceeding of coarse solids through the grinding chamber 2 to the discharge opening 5 is prevented by means of the classifier 14, they are returned to the grinding chamber 2 to be further comminuted by the ball charge 3. Only such elements of the mill product that fall under a given grain size are let out of the mill through the classifier 14.

The classifier 14 comprises a screen 15 divided into screen segments, advantageously into four similar and equally large screen segments 16, 17, 18 and 19. The screen segments are located inside a cylindrical shell 20. Each screen segment 16, 17, 18 and 19 comprises a segment side 22, 23, 24 and 25, directed radially outwards from the axis B—B. The screen surfaces 26, 27, 28 and 29 are arranged in between said sides 22, 23, 24 and 25, on a vertical plane to the axis B—B, so that the screen surfaces extend from the first segment side 22 to the second segment side 23 and so on, and also so that the fastening points in the segment sides are on different levels in relation to the axis B—B.

The screen 15 is provided with a front plate 21. The front plate 21 is provided with openings so that the openings 30, 31, 32 and 33 of the first group are located near the circumference of each screen segment, near the cylindrical shell 20 and adjacent to the segment side 22, 23 24 and 25, next after the side in question with respect to the rotating direction C. Respectively, the openings 34, 35, 36 and 37 of the second group are arranged in connection with each screen segment, near the axis B—B and the discharge opening 5, so that they are located adjacent to the segment sides 22, 23, 24 and 25, before said sides when seen in the rotating direction C, as is seen in FIG. 3. The opening size of the screen surfaces 26, 27, 28 and 29 of the screen 15 can advantageously be chosen in the area 10–200 $\mu$m, depending on the material to be ground. The choice of the screen opening size directly affects the grain size which is being classified.

In the grinding process, the feed slurry density is set to be such that its dry content is of the order 45% by weight or less. In that case, the dry content of the slurry to be treated in the mill 1 and particularly in the grinding chamber 2 is set at the steady-state pulp density. Said steady-state pulp density is higher than the feed slurry density, advantageously within the area 45–60% by weight. The excess water formed of the difference of the slurry densities flows more rapidly through the grinding chamber 2 of the mill 1 than the slurry that is being processed. On the outlet side of the mill, the product to be treated is in this embodiment also classified in the classifier 14 so that the coarse element in the slurry is returned to the grinding process. The classifier 14, and particularly its screen structure 15, performs pumping while the grinding chamber 2 rotates in the direction C. The slurry to be treated in the grinding chamber 2 is then shifted, in the outlet end of the chamber, through each opening 30, 31 32 and 33 provided in the front plate 21 of the classifier 14, to the front spaces 38, 39 of respective screen segments 16, 17, 18 and 19, when said opening falls underneath the slurry surface L. At lowest, each opening (for instance 32) is at the distance $h_{eff}$ from the slurry surface L. In this position, the hydrostatic pressure for shifting the slurry from the grinding chamber 2 to the front space (for example 38) of a screen segment (for example 19) is at highest. The front space (for example 38) of a screen segment (for example 19) starts to fill immediately after the opening (for example 32) of the screen segment falls under the slurry surface L along with the rotating of the mill and the filling ends, when the opening rises above the slurry surface L. The segment sides (for instance 25) prevent the slurry from being transported from one front space of the screen segment (for example 13) in the rotating direction C to the front space of the successive screen segment (for example 16). On the other hand, by means of the segment side (for example 25), slurry is lifted in the front space (for example 19) above the slurry surface L, where the screening of the slurry mainly takes place, while the slurry is shifted partly from the front space (for example 38) of each screen segment through the screen surface (for example 28) to the rear space (for example 40) of the screen segment. The part of the slurry with a grain size smaller than that of the openings in the screen 15 is shifted through the screen surfaces 26, 27, 28 and 29 further to the rear space 40, 41 of the screen and therefrom through the discharge openings 46 of the screen to the discharge opening 5 of the mill and further. Material which does not fit through the openings of the screen surfaces 26, 27, 28 and 29 is returned from the front space 38, 39, 40 and 41 via the second screen openings 34, 35, 36 and 37 back to the grinding chamber 2 to be ground further.

The outlet of the mill 1, i.e. the discharge opening 5 of the grinding chamber 2 is connected, via the outlet channel 47 to the mill product collecting tank 48 or the like. In this embodiment, in connection with the collecting tank 48, there is provided a balance 49 for weighing the mill product obtained from the mill 1.

In addition to the solids and water feed, to the feed channel 12 of the mill 1 there can also be connected one or several channels 50 in order to feed suitable chemicals from the chemical unit 51 to the grinding process. The chemical unit 51 contains for example a number of chemical pumps 52 and connected containers 53.

In connection with the outlet channel 47 of the mill 1, there also are advantageously provided, among others, a pH measuring unit 54 and a Redox potential measuring unit 55 in order to define the properties of the mill product.

The mill 1 provided in the grinding apparatus of FIGS. 1, 2 and 3 is a laboratory mill which is continuously operated and classifying. The outer diameter D of the grinding chamber 2 of this mill 1 is 190 mm, and the length L of the grinding part is 220 mm. The connecting of the classifier 14 to the mill 1, as a continuation of its grinding part, has extended the total length $L_{tot}$ of the mill to 255 mm. In principle the classifier 14 is a screen, as was explained above. It is composed of four, five or six screen segments arranged on the level of the end plate of the mill. The total volume of the mill capacity is about 6.61, of which the grinding chamber is 6.241 and the classifier part 0.361. The grinding chamber 2 of the mill 1 is rotated by means of rotating rollers 6 at a standard rate, which generally with a mill of this size is 60 rpm, but can also be adjusted.

The grinding method according to the invention has been studied by means of the above described apparatus and with several different ore samples. These ore samples were the following: (1) Ni ore (hard gangue) from Talvivaara, Sotkamo, (2) Cr ore (hard gangue) from Kemi, (3) Cr ore (soft gangue) from Kemi, (4) Ni ore (soft gangue) from Hitura, (5) Oxidic Cu ore (medium-hard gangue) from Zaldivar, and (6) talc ore from Vuonos. The materials were crushed by 100% to 1 mm, to the same degree of coarseness as is customary with feed materials in laboratory experiments.

The significance of the size of the ball charge in the mill to various factors, such as the mill capacity, the mill filling volume and the fineness of the product were investigated by varying the size of the grinder charge in the mill stepwise within the range of 3–12 kg (6–24% volume of the grinder part). Respectively, the significance of the feed slurry density was studied by varying it stepwise within the range of 45–35% by weight. With the Hitura ore (material 4), the lowest tested slurry density was 25% by weight. The reason for the fact that the highest slurry density used in the experiments was only 45% by weight was an observation made in preliminary tests, i.e. that some materials (4 Hitura, 3 Kemi Cr ore/soft gangue) were muddled into a thick mass which was very difficult to handle, if too little water was used (for instance 60% by weight slurry density). Apparently the moving of the material in the mill and/or its screenability becomes remarkably difficult already before reaching said congealed state.

The grinding method according to the invention was researched in the first step by studying the influence of the size of the ball charge to the mill capacity, by changing the ball charge in the mill step by step from 3 to 12 kilos and by searching a maximum capacity for each ball charge by simultaneously observing the development of the mill filling rate. As accepted capacity values, there were only acknowledged such feed values that lead to a balanced situation (=the mill filling volume was stabilized with standard feed to a given steady-state level, independent of time). By means of this procedure, there was obtained for the various materials 1–5 under investigation a capacity dependence on the size of the ball charge. The results are presented for instance in FIGS. 4–7. Curves represented in the drawings can be called specific curves of the various ore materials 1–5. Said curves show that these ore materials do not behave in similar fashion, but as a rule each one of them is an individual and behaves according to its own rules.

In the curves of FIG. 4 it is seen that when the size of the ball charge was increased from 3 to 12 kilos, the capacity with the tested materials rose first in a linear fashion, with a slope characteristic to each material. As a general rule, the angle coefficient is constant only to a certain limit, i.e. to the point of change, and thereafter the angle coefficient is reduced to another constant value. In the curve graph of FIG. 4, the point of change is located, with both Kemi chromites (materials 2 and 3) and with the Talvivaara nickel ore (material 1) at a point where the ball charge in the mill is 8 kg. On the other hand, with the Zaldivar copper ore (material 5), there was not detected any conspicuous change of point, but a slight change in the angle coefficient towards lower values took place when the ball charge was 6 kg. As for the Hitura ore (material 4), any apparent chances in the angle coefficient were not detected, because the material is easily ground.

However, on the basis of the curve graph of FIG. 4, it can be maintained that the point of change indicates the size of an optimal ball charge. The growing of the ball charge over the point of chanae does not increase the mill capacity to a similar extent as before the point of change. It is also possible to find for the ball charge an optimum size, the surpassing whereof results in the reduction of the mill capacity (cf. FIG. 7).

The dependence of the mill filling volume on the size of the ball charge with a standard slurry density is illustrated in FIGS. 5, 6 and 7. Naturally the growing of the ball charge has a similar effect on the mill filling volume as it has on the capacity, i.e. increasing. The mill filling volume is a sum of two factors: total filling volume=ball volume+slurry volume. Consequently: even if the slurry filling were not increased, the total filling volume already increases with an increase in the ball filling.

When observing FIG. 5, it is seen that while the feed slurry density decreases from 45.5% to 35% by weight, the mill capacity grows noticeably with ball charges of 4–10 kilos. The same observation can be made on the basis of the curve graph shown in FIG. 6, where the sample ore is the Hitura nickel ore (material 4) with two different feed slurry densities: 25% and 45.5% by weight. It is pointed out that the capacity values obtained with the Hitura ore are the highest, which is mainly due to the fact that this material grinds well.

In FIG. 7 it is seen that with one ore material (material 6: the Vuonos talc ore) the growing of the ball charge over a certain limit, roughly 8 kg, reduces the mill capacity. Moreover, FIG. 7 shows that the reduction of the feed slurry density from 45.5% to 35% by weight clearly increases the mill capacity, and that for the ball charge there can be found an optimum size, which is roughly 8 kg. It will be appreciated that the grinding capacity does not grow in linear fashion along with the growth of the ball charge (cf. also FIG. 4). The angle coefficient of the curves is constant until the point of change, but changes radically thereafter.

In principle of operation, a mill realizing the grinding method according to the invention is classifying (water classification or combined water classification and screening). Now the mill essentially produces a standard product as for grain size, and there are not any remarkable differences in the fineness of the product, even if the size of the ball charge is changed. This is true on the condition that the milling capacity of the mill does not surpass the common top limit of screening capacity and slurry pumping. It was found out that this condition is fulfilled with normal mill capacities. Furthermore, research found out that in the various cases, there were only minor differences in the fineness of the mill product, when comparing products obtained with charges of different sizes in cases, where the feed slurry density was kept at a standard value. The fineness (maximum coarseness) of the mill product can be changed only by changing the opening size of the screens of the mill classifier.

In the grinding method of the invention, the steady-state pulp density in the mill is as a rule independent of the slurry density of the material fed into the mill. Hence, in a balanced situation of the grinding process, free water passes through the mill remarkably faster than the thicker slurry with a steady-state pulp density and therealong the solids. This thick element is formed in between the intermediate matrix between the grinder pieces, and the free slurry space is formed above them. This naturally results in that the water, proceeding faster than the solids, efficiently carries the fine grain sizes of the material to be ground through the mill.

FIG. 8 illustrates flushing flows of the free water corresponding to the feed slurry density, when the solids in the mill feed are 100 g, 150 g and 200 g. On the basis of these curves it is observed that while the feed slurry density decreases from 45to 25% by weight, the volume of free water passing through the mill grows at best from the rate of 100 ml/min to 350 ml/min, when the feed rate of solids is 200 g/min.

FIG. 9 shows some calculations based on measurements as for the delay times of solids and water in the mill with feed slurry densities varying from 35 to 45% by weight. In the measured values it is observed that the delay time of solids (k.a.) is 11 minutes when the grinder charge is 3 kilos iron balls (Fe), and respectively the delay time of water is about 3.7 minutes. Other points of the curve can be studied in the same fashion.

Consequently, water flushes the mill during the grinding process, and this flushing saves the smallest particles from overgrinding; as a result, energy is saved and there is obtained a better product. It is well known that the grinding of fine material into even finer consumes a large amount of energy. While the flushing empties the mill of ready-ground material, it makes room for new feed and thus increases the mill capacity. The more the feed slurry density deviates from the steady-state pulp density of the mill towards a thinner slurry density, the stronger this phenomenon is. These facts can also be observed in the curve graphs of FIGS. 6. 7 and 8.

In an ordinary mill in a production process, the feed slurrv density is of the order 50–65 % by weight, in which case the fed solids/water ratio is practically equal to the steady-state pulp density created in the mill. In that case the materials pass through the mill in a so-called plug flow, where water and solids proceed through the mill at the same rate, and the flushing phenomenon does not appear. In the grinding method according to the invention, the material flow through the mill is changed into a classifying flow, so that the slurry density of the material to be fed in the mill is remarkably reduced as compared to the prior art. The new grinding method also considerably increases the capacity of industrial-scale mills and cuts the overfine grain element in the mill product, which also reduces energy consumption in the process.

In the experiments it was found out that the slurry density in the mill in a balanced situation, i.e. a steady-state pulp density, is mainly nearly constant, about 60% by weight (58–62% by weight), which is almost independent of the feed slurry density. This is the case for instance with the Talvivaara ore (material 1). A similar phenomenon was detected with the Hitura ore (material 4), but the steady-state pulp density corresponding to a balanced situation in the mill dropped, as the feed slurry density dropped. With this material, there were formed two different steady-state pulp densities in the mill, 60 and 45% by weight, when the feed slurry densities were 45and 25% by weight. FIG. 10 illustrates a mill slurry filling volume vs. a maximum feed of solids, obtained with the Talvivaara ore sample, and respectively FIG. 11 illustrates the mill slurry filling volume vs. a maximum feed of solids, obtained with the Hitura ore sample. With both these ore materials, it was found out that the mill filling volume was decreased when the feed slurry density was decreased, irrespective of an increased mill capacity. From the results it is seen that in the results obtained with the Hitura ore material, the dropping of feed slurry density had a remarkably more positive influence, because the fluidity of the Hitura ore slurry is strongly dependent on the slurry density (inversely proportional). The decrease in the steady-state pulp density inside the mill in the case of the Hitura ore is mainly due to the soft gangue material.

In the grinding process according to the invention, a reduction of the mill feed slurry density increases the grinding capacity of the mill. As was maintained above, this is a result of a more efficient discharge of ready-ground material from the mill, which discharge cuts the delay time of the more easily transported elements (fine and/or light elements) in the mill. The more the feed slurry density deviates from the steady-state pulp density inside the mill towards the lower direction, the stronger is the flushing inside the mill and the shorter becomes the delay time of the finest elements in the mill. This was already apparent from FIGS. 8 and 9 above, as well as from FIG. 12.

FIG. 12 illustrates the delay times of solids and water in the mill with different feed rates of the solids in the feed. The shortening of the delay time of the finer elements in the mill product naturally results in a reduction of the proportion of these elements in the product. This is also shown in the accompanying drawing 13, which shows the averaged screen analyses of the product with two slurry densities, 35 and 45.5% by weight. In these results it is seen that a reduction in slurry density clearly reduces the passing-through value of the fine elements. In the finer elements, the angle coefficient of the function of the grain size distribution of the mill product becomes more advantageous (larger angle coefficient=relatively less fine elements).

The curve graphs illustrated in FIGS. 9 and 12 are obtained by calculating the delay times of solids and water as functions of the feed rate and the feed slurry density. The calculations are made on the basis of the measured steady-state mill filling volume and steady-state pulp density. Hence the results are only rough estimates, but they clearly prove the existence of the flushing phenomenon and its growth when shifting towards a lower feed slurry density.

In the mill 1 of FIG. 2, the discharge means provided in connection with the discharge opening 5 can, instead of the classifier 14, be a pumping device, as was maintained above. In that case the pumping device resembles the classifier 14, with the difference that a screen 15 is not used. The slurry passing freely through the grinding chamber 2 is lifted by means of the pumping device out of the discharge opening 5.

The ratio of the length L of the mill in FIG. 2 to the mill diameter D is roughly 1. It will be appreciated that by increasing the D/L ratio in the mill, the water flow rate through the mill chamber can be increased, because when the diameter D increases, the transversal area decreases as compared to the capacity. This has a further reducing effect on the delay time of very fine solids in the mill. Respectively, when the mill diameter D increases, the size of the feed opening 4 and the discharge opening 5 can be increased, as well as the sizes of the openings connected to the classifier (if a classifier is used). The opening size of the screen 15 can, if necessary, be adjusted to be suitable. As a rule, the opening size in the screen segments of the screen 15 depends on the size of the mill; with a laboratory-scale mill, the opening size is for instance of the order 10–200 $\mu$m, whereas the opening size in an industrial-scale mill can be for instance of the order 0.5–10 mm. The ratio of the diameter D of the grinding chamber 2*a* of the mill 1*a* to its length L is most advantageously adjusted so that $D/L \geqq 2$, as is illustrated in FIG. 14. Thus there is obtained an optimal shape of the mill and particularly of the grinding chamber, where low values of the feed slurry density are further utilized, as was described above. In that case, there is not necessarily needed a classifier on the discharge side of the mill, as in the mill of FIG. 2, but it can naturally be added to the mill if necessary.

On the basis of the test results described above, let us now summarize the advantages of the grinding method according to the invention:

At the research state, ore materials with different hardnesses can be separated as individuals and grouped into hardness groups (FIG. 4: different angle coefficient of the solids and the mill capacity, and of the ball charge, as well as the point of change of the angle coefficient). On the basis of the obtained results, a forecast of utilization can be made for each ore material individually.

An optimal size of the grinder charge can be determined for different ore materials (FIGS. 4, 5 and 7).

An optimal feed slurry density can be determined for different ore materials (FIGS. 6, 7, 8 and 9).

By lowering the feed slurry density, there is achieved both a drop in the mill filling volume and an increase in the grinding capacity (FIGS. 6 and 10, as well as FIGS. 7 and 11).

The grain size distribution in the mill product changes toward the desired direction, i.e. the proportion of the extremely fine elements decreases (FIG. 13).

In the grinding process, in the grinding chamber of the mill, both transport and classification are improved, which factors help prevent overgrinding (FIGS. 8, 9 and 13). This saves energy and reduces the proportion of overfine grain sizes in further processes. Fine grain sizes (=slime) increase process costs in concentration, and generally deteriorate the concentration result.

It is further pointed out that the grinding process according to the invention as such is classifying, wherefore the classifier 14, described for instance in connection with the mill 1 of FIGS. 2 and 3, is not necessarily needed in the mill. The water flow as such classifies the material to be ground in the grinding chamber 2 and carries the finer and lighter elements of the ground material faster than others. The main purpose of the classifier is to prevent the access of too large particles through the mill and to form a closed, classifying circuit where a two-step classification is carried out. This is particularly important when the dimensions of the mill, i.e. the ratio of the mill diameter D to the length L of the grinding part, is not larger or equal to 1.

In the above specification, the invention and some of its modifications were explained with reference to one preferred mill embodiment and test results only. It is, however, apparent that the invention can be applied in many different ways within the scope of the inventional idea defined in the accompanying claims.

We claim:

1. A method of grinding granular solids comprising the steps of feeding a liquid slurry of the solids to a grinding mill containing grinder charge pieces, said pieces forming an intermediate space matrix in which the solids are dispersed, said solids limiting the space for liquid in said matrix and thereby establishing a predetermined solids density of the slurry therein, operating the mill and discharging the ground solids therefrom at a first weight rate, adjusting the flow rate of the feed slurry to maintain the feed weight rate of solids equal to said first rate, and measuring and maintaining the solids density of the feed slurry at a selected value below said predetermined density, thereby increasing the discharge rate of liquid from the mill corresponding to said value and flushing the solids of smaller grain size from the mill more rapidly than the solids of coarser grain size.

2. A method according to claim 1, in which the first solids density is below 45 percent and said predetermined solids density is above 45 percent.

3. A method according to claim 1, including providing a classifier for the material being discharged from the mill to discharge the liquid freely while discharging only particles of the solids below a predetermined grain size.

4. A method according to claim 3, in which the material discharged from the mill is passed through a screen of a predetermined screen opening size.

5. A method according to claim 1, in which the grinding is produced by tumbling a ball charge within a confined volume, the weight of the charge being adjusted to the maximum value above which the slope of the curve plotting feed weight rate of solids versus the weight of said charge substantially decreases.

6. A method according to claim 1, in which the feed solids density is controlled by first separately feeding the solids and liquid while measuring and adjusting their relative weight rates, and then combining the solids and liquid.

7. Apparatus for grinding granular solids comprising, in combination, a mill having a grinding chamber provided with feed and discharge openings and drive means for rotating the chamber, a charge of grinder pieces in the chamber, means to feed a liquid slurry of the solids into the mill, the grinder charge forming an intermediate space matrix in which the solids are dispersed, said solids limiting the space for liquid in said matrix and thereby establishing a predetermined solids density of the slurry therein, means for operating the drive means to cause the mill to discharge ground solids therefrom at a first weight rate, and means adapted to adjust the flow rate of the feed slurry to maintain the feed weight rate of solids equal to said first rate, and further adapted to measure and maintain the solids density of the feed slurry at a selected value below said predetermined density, thereby increasing the discharge rate of liquid from the mill corresponding to said value and flushing the solids of smaller grain size from the mill more rapidly than the solids of coarser grain size.

8. Apparatus according to claim 7, in which the solids density of the feed slurry is adjusted to a value at or below 45 percent by weight.

9. Apparatus according to claim 7, in which said adjusting means include means to measure and separately control the respective feed rates of the solids and liquid prior to mixing them to form the feed slurry.

10. Apparatus according to claim 7, in which the mill includes a classifier communicating between the grinding chamber and the discharge opening, said classifier having means to permit the passage of solids below a predetermined grain size to the discharge opening and to return the solids of larger grain size to the grinding chamber.

11. Apparatus according to claim 10, in which the last mentioned means comprise a screen.

12. Apparatus according to claim 7 or claim 9, in which the grinding chamber is substantially cylindrical and has a diameter at least as great as its length.

13. Apparatus according to claim 7 or claim 9, including a torque measuring device on said drive means for rotating the grinding chamber.

* * * * *

UNITED STATES PATENT AND TRADEMARK OFFICE

CERTIFICATE OF CORRECTION

PATENT NO. : 5,954,276
DATED : September 21, 1999
INVENTOR(S) : Väinö Viljo Heikki Hintikka, et al It is certified that error appears in the above-indentified patent and that said Letters Patent is hereby corrected as shown below:

Column 4, line 43, after classifier 14, delete "," and substitute --;--

Column 5, line 41, cancel "13" and substitute --19--

Column 6, line 19, cancel "6.61" and substitute --6.6 l--; line 20, cancel "6.241" and substitute --6.24 l--; cancel "0.361" and substitute --0.36 l--

Column 7, line 18, cancel "chances" and substitute --changes--; line 24, cancel "chanae" and substitute --change--

Column 8, line 50, cancel "slurrv" and substitute --slurry--

Column 11, line 23, cancel "first" and substitute --feed--

Signed and Sealed this

First Day of May, 2001

*Attest:*

Nicholas P. Godici

NICHOLAS P. GODICI

*Attesting Officer*

*Acting Director of the United States Patent and Trademark Office*